US010309276B2

(12) United States Patent
Baxter et al.

(10) Patent No.: US 10,309,276 B2
(45) Date of Patent: Jun. 4, 2019

(54) ON-ENGINE FLUID MONITORING SYSTEM

(71) Applicant: Caterpillar Inc., Peoria, IL (US)

(72) Inventors: Corey Everette Baxter, Valparaiso, IN (US); Douglas Edward Davis, Lafayette, IN (US); Mircea Radu Farmus, West Lafayette, IN (US)

(73) Assignee: Caterpillar Inc., Deerfield, IL (US)

( * ) Notice: Subject to any disclaimer, the term of this patent is extended or adjusted under 35 U.S.C. 154(b) by 317 days.

(21) Appl. No.: 15/276,204

(22) Filed: Sep. 26, 2016

(65) Prior Publication Data

US 2018/0087414 A1 Mar. 29, 2018

(51) Int. Cl.

| | |
|---|---|
| ***F01M 1/18*** | (2006.01) |
| ***F01M 1/02*** | (2006.01) |
| ***F01M 1/10*** | (2006.01) |
| ***F01M 5/00*** | (2006.01) |

(52) U.S. Cl.

CPC ..... *F01M 1/18* (2013.01); *F01M 1/02* (2013.01); *F01M 1/10* (2013.01); *F01M 5/002* (2013.01); *F01M 2250/60* (2013.01)

(58) Field of Classification Search

CPC .. F01M 1/18; F01M 1/02; F01M 1/10; F01M 5/002; F01M 2250/60

See application file for complete search history.

(56) References Cited

U.S. PATENT DOCUMENTS 3,053,051 A * 9/1962 Kelley ..... 60/329
3,913,831 A 10/1975 Talak
5,220,892 A * 6/1993 Boemer ..... F01M 1/16 123/196 AB
5,339,776 A * 8/1994 Regueiro ..... F01M 1/16 123/196 AB
5,551,389 A * 9/1996 Kahrs ..... B60K 25/02 123/196 R
5,762,134 A 6/1998 Droste et al.
5,890,509 A 4/1999 Becker et al.
6,912,895 B1 7/2005 Jaeger
7,195,055 B1 * 3/2007 Jaeger ..... F01P 3/20 123/41.15
7,997,505 B2 8/2011 Martin et al.
8,141,524 B2 3/2012 White et al.
9,133,952 B2 9/2015 Lamb et al.
(Continued)

FOREIGN PATENT DOCUMENTS

| | | |
|---|---|---|
| CN | 101403403 B | 3/2013 |
| GB | 1056209 A | 1/1967 |
| KR | 101161307 B1 | 7/2012 |

*Primary Examiner* — Michael A Riegelman
(74) *Attorney, Agent, or Firm* — Miller, Matthias & Hull
Oblon, McClelland, Maier & Neustadt

(57) ABSTRACT

A monitoring system for monitoring fluid parameters in a lubrication system of an engine may include an input conduit configured to be in fluid communication with the lubrication system at a first location upstream of an oil cooler of the lubrication system. A monitoring device may be in fluid communication with the input conduit. An output conduit may be in fluid communication with the lubrication system at a second location downstream of the oil cooler. The output conduit may include a flow restrictor configured to provide a desired pressure and flow of a fluid to the monitoring device via the input conduit.

20 Claims, 3 Drawing Sheets

(56) References Cited

U.S. PATENT DOCUMENTS

| | | | | |
|---|---|---|---|---|
| 2002/0128107 | A1* | 9/2002 | Wakayama | F16H 57/0412 475/161 |
| 2003/0139894 | A1* | 7/2003 | Ryan | G01K 17/12 702/132 |
| 2004/0031463 | A1* | 2/2004 | Williams | F01M 1/02 123/196 S |
| 2004/0059542 | A1* | 3/2004 | Apostolides | F01M 1/18 702/182 |
| 2005/0039719 | A1* | 2/2005 | Moss | F01M 1/12 123/196 AB |
| 2006/0213552 | A1* | 9/2006 | Sparks | B60T 17/18 137/2 |
| 2007/0084431 | A1* | 4/2007 | Omachi | F01M 1/02 123/196 R |
| 2010/0154427 | A1* | 6/2010 | Logan | F01D 25/18 60/772 |
| 2011/0000188 | A1* | 1/2011 | Pegg | F01M 5/001 60/273 |
| 2013/0318940 | A1* | 12/2013 | Parnin | F02C 7/06 60/39.08 |
| 2013/0330205 | A1* | 12/2013 | Apostolides | F01M 5/025 417/12 |
| 2014/0290761 | A1* | 10/2014 | Apostolides | F01M 11/0458 137/511 |
| 2015/0159774 | A1 | 6/2015 | Kim | |
| 2015/0330273 | A1* | 11/2015 | Chung | F01M 5/002 701/34.4 |
| 2016/0061071 | A1 | 3/2016 | Lee et al. | |

* cited by examiner

ON-ENGINE FLUID MONITORING SYSTEM

TECHNICAL FIELD

The present disclosure relates generally to lubrication systems for engines and, more particularly, relates to fluid monitoring systems for such lubrication systems.

BACKGROUND

Generally, a fluid, such as oil, is circulated through an engine for lubrication during operation. Before flowing to the engine, the oil usually passes through a filter to remove contaminants. In addition to lubricating the engine, the oil also cools the engine by absorbing heat. The hot oil typically flows from the engine into an oil pan or sump to be recirculated through the system. The hot oil, however, generally needs to be cooled before recirculation through the system. As such, in some large engine systems, for example, an oil pump typically pumps the hot oil from the oil pan to flow through an oil cooler to cool the oil before flowing to the oil filter.

In some large engine systems, an oil cooler bypass valve is arranged upstream of the oil cooler to regulate the flow of oil to the oil cooler. For example, with the engine running, the oil may be hot and less viscous such that the oil cooler bypass valve regulates the hot oil to flow directly to the oil cooler for cooling. On the other hand, during engine start-up when the oil is typically cold and more viscous, the oil cooler bypass valve directs a portion of the cold oil to bypass the oil cooler to avoid damaging the oil cooler. As the oil circulates through the system, it may be desirable to monitor the properties of the oil to ensure proper oil performance and efficient engine operation. In such large engine systems, the oil flow and pressure is relatively high compared to smaller engine systems and, as such, may present difficulties in effectively monitoring the properties of the oil as it circulates through the large engine system.

U.S. Patent Application Publication No. 2016/0061071 is a general reference of an engine system including an oil cooler and a bypass apparatus arranged so that oil may selectively bypass the oil cooler. However, improvements in oil and other fluid monitoring systems for engines continue to be sought.

SUMMARY

In accordance with an aspect of the disclosure, a monitoring system for monitoring fluid parameters in a lubrication system of an engine is provided. The monitoring system may include an input conduit configured to be in fluid communication with the lubrication system at a first location upstream of an oil cooler of the lubrication system. A monitoring device may be in fluid communication with the input conduit. An output conduit may be in fluid communication with the lubrication system at a second location downstream of the oil cooler. The output conduit may include a flow restrictor configured to provide a desired pressure and flow of a fluid to the monitoring device via the input conduit.

In accordance with another aspect of the disclosure, an engine is provided. The engine may include a cooler bypass in fluid communication with, and downstream of, a pump. The cooler bypass may include a bypass valve. An oil cooler may be in fluid communication with, and downstream of, the cooler bypass. A monitoring system may fluidly couple a first location upstream of the cooler bypass to a second location downstream of the oil cooler. The monitoring system may include a flow resistor configured to provide a desired pressure and flow of a fluid to flow through the monitoring system from the first location to the second location.

In accordance with yet another aspect of the disclosure, a lubrication system for an engine is provided. The lubrication system may include an oil cooler. The oil cooler may include a cooler inlet and a cooler outlet. The cooler inlet may be upstream of the cooler outlet. A first location may be upstream of the cooler inlet and a second location may be downstream of the cooler outlet. A monitoring device may include an input conduit and an output conduit. The input conduit may be in fluid communication with the first location. The output conduit may be in fluid communication with the second location. One of the input conduit and the output conduit may include a flow restrictor configured to provide a desired pressure and flow of a fluid to the monitoring device via the input conduit.

These and other aspects and features of the present disclosure will be more readily understood upon reading the following detailed description when taken in conjunction with the accompanying drawings. Aspects of different embodiments herein described can be combined with or substituted by one another.

It is to be noted that the appended drawings illustrate only typical embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION

Figure 1:
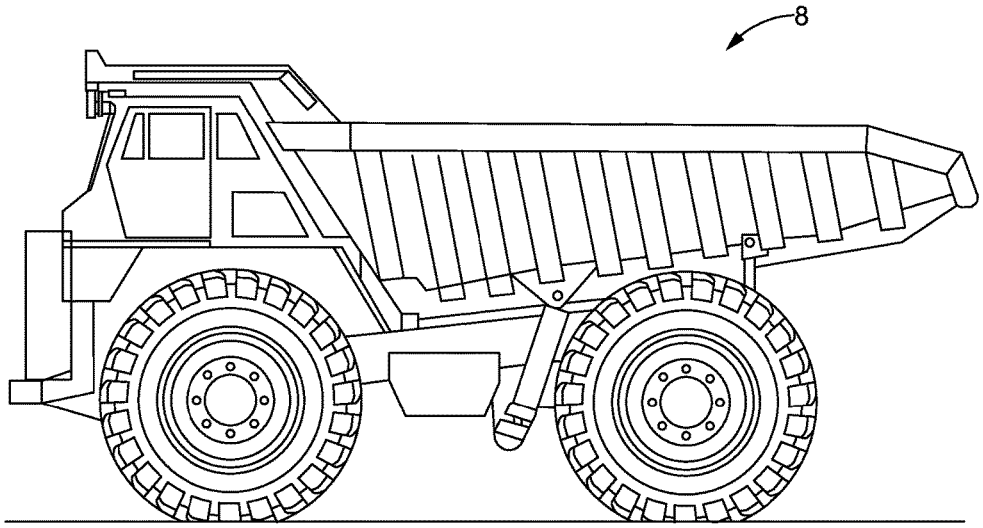
FIG. 1 is a perspective view of an off-highway truck, in accordance with an embodiment of the present disclosure.

Referring now to FIG. 1, an exemplary off-highway truck constructed in accordance with the present disclosure is generally referred to by reference numeral 8. The off-highway truck 8 may be utilized in a wide variety of industries such as, but not limited to, mining, earth-moving, agricultural, and construction, to name a few example. The off-highway truck 8 includes an engine 10 (shown in FIG. 2). The engine 10 may be any type of engine such as, but not limited to, diesel engines, gas turbine engines, marine engines, generator sets, and other engines well-known in the industry. It should be generally understood that while the engine 10 is illustrated in use with the off-highway truck 8, the engine 10 may also be utilized in other environments such as, but not limited to, marine propulsion, power generation, and fluid extraction.

Figure 2:
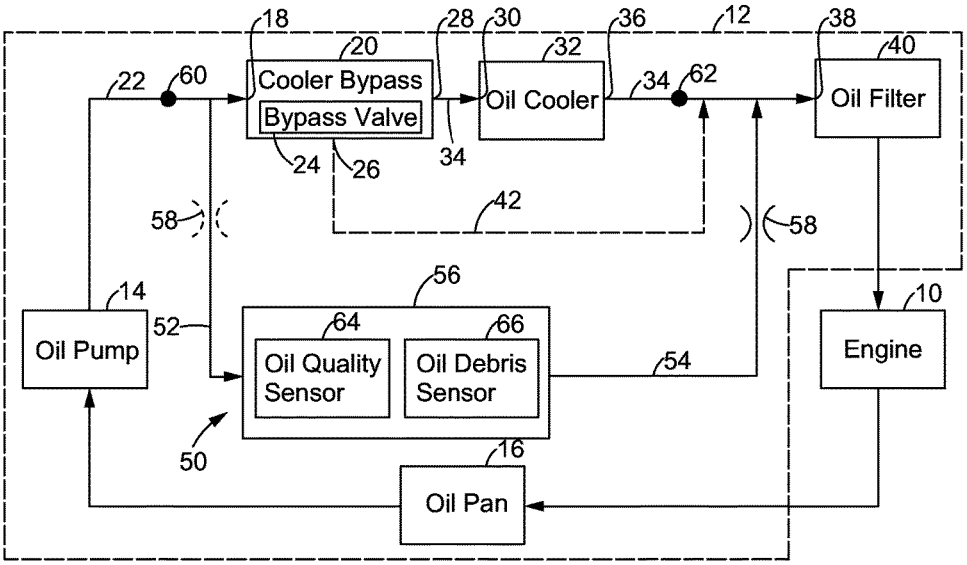
FIG. 2 is a block diagram illustrating an exemplary lubrication system of an engine, in accordance with an embodiment of the present disclosure.

With reference to FIG. 2, the engine 10 includes a lubrication system 12 in fluid communication therewith for circulating a fluid, such as oil for example, through the engine 10 for lubrication and cooling. The lubrication system 12 includes a pump 14 in fluid communication with an oil pan 16 or sump, which is in fluid communication with the engine 10. The pump 14 is further in fluid communication with an inlet port 18 of a cooler bypass 20. The inlet port 18 of the cooler bypass 20 receives oil from the pump 14 via supply flow path 22. The cooler bypass 20 also includes a bypass valve 24, a bypass port 26, and an outlet port 28 in fluid communication with a cooler inlet 30 of an oil cooler 32.

The bypass valve 24 of the cooler bypass 20 is configured to control oil flow to pass through the outlet port 28 to the oil cooler 32 via a cooler flow path 34 and, under certain conditions such as when the oil is cold and viscous, to direct part of the oil flow to bypass the oil cooler 32 via the bypass port 26. The oil cooler 32 also includes a cooler outlet 36 in fluid communication with a filter inlet 38 of an oil filter 40 such that the cooler flow path 34 continues from the cooler bypass 20 through the oil cooler 32 and to the oil filter 40. As such, the filter inlet 38 of the oil filter 40 receives oil from the cooler outlet 36 of the oil cooler 32 via the cooler flow path 34. Moreover, the filter inlet 38 of the oil filter 40 is in fluid communication with the bypass port 26 of the cooler bypass 20 via a bypass flow path 42, such that the filter inlet 38 can also receive oil from the bypass port 26 of the cooler bypass 20, depending on the position of the bypass valve 24. In some embodiments, the bypass flow path 42 is in fluid communication with the cooler flow path 34 downstream of the cooler outlet 36 so that the oil flowing from the bypass port 26 combines with oil flowing from the cooler outlet 36 to flow to the filter inlet 38. The oil filter 40 is also in fluid communication with the engine 10 and filters out contaminants from the oil before flowing to the engine 10.

Figure 3:
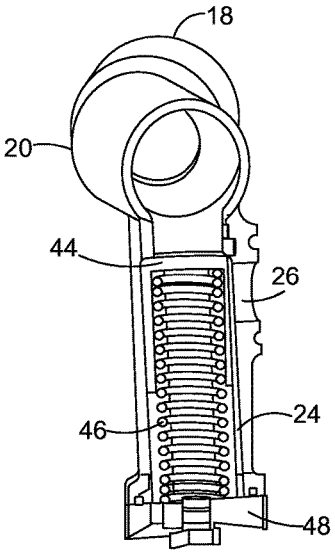
FIG. 3 is a partial cross-sectional view of a cooler bypass in a cooler-flow position, in accordance with an embodiment of the present disclosure.
Figure 4:
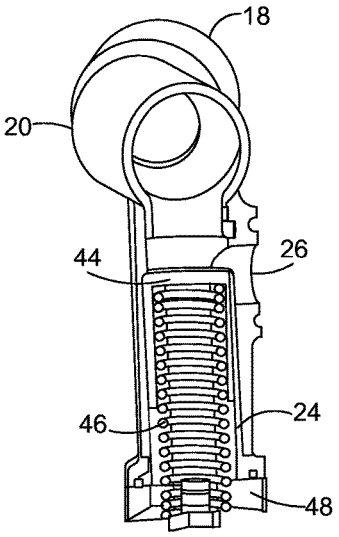
FIG. 4 is a partial cross-section view of a cooler bypass in a bypass flow position, in accordance with an embodiment of the present disclosure.

With reference to FIG. 3, an exemplary cooler bypass, such as the cooler bypass 20, is illustrated to depict the operational relationship of the bypass valve 24 within the cooler bypass 20 for controlling oil flow. The bypass valve 24 includes a spool 44 and a biasing member 46, which urges the spool 44 away from a base 48 such that the spool 44 is arranged in a cooler-flow position (illustrated in FIG. 3) to restrict oil flowing from the inlet port 18 to the bypass port 26 while allowing oil to flow from the inlet port 18 to the oil cooler 32. Further, the biasing member 46 continues to urge the spool 44 in the cooler-flow position until pressure exerted on the spool 44 overcomes a preload force of the biasing member 46, at which point, the force of pressure on the spool 44 compresses the biasing member 46 toward the base 48 until the spool 44 reaches a bypass-flow position. With the spool 44 arranged in the bypass-flow position, as illustrated in FIG. 4, access is open to the bypass port 26 such that oil flowing from the inlet port 18 is partially diverted through the bypass port 26 to the oil filter 40 via the bypass flow path 42.

For example, when the oil is cold and viscous, such as during engine start-up, the oil pressure on the spool 44 is greater than the preload force of the biasing member 46 forcing the spool 44 to transition from the cooler-flow position to the bypass-flow position such that a portion of oil begins diverting through the bypass port 26 to bypass the oil cooler 32. On the other hand, when the oil is warm or hot, such as during operation of the engine 10, the oil pressure on the spool 44 is less than the preload force of the biasing member 46 such that the biasing member 46 biases the spool 44 into the cooler-flow position restricting oil flow to the bypass port 26.

Referring back to FIG. 2, the lubrication system 12 further includes a monitoring system 50 for monitoring properties of the oil. The monitoring system 50 includes an input conduit 52, an output conduit 54, and a monitoring device 56 in fluid communication with the input conduit 52 and the output conduit 54. The monitoring device 56 is in fluid communication with the supply flow path 22 via the input conduit 52 and is in fluid communication with the oil filter 40 via the output conduit 54. The monitoring system 50 further includes a flow restrictor 58. The flow restrictor 58 is configured to limit the pressure and flow of oil through the monitoring system 50 to be in compliance with the operational pressure and flow parameters of the monitoring device 56. In some embodiments, the flow restrictor 58 is disposed in the output conduit 54 and may be a defined orifice constricting passage through the output conduit 54 resulting in limiting the pressure and flow of oil passing through the input conduit 52 of the monitoring system 50 from the supply flow path 22 such that the pressure and flow of oil through the input conduit 52 is less than that of the supply flow path 22. For example, the flow of oil through the input conduit 52 is an order of magnitude less than the flow of oil at the supply flow path 22 such that the temperature of the oil flowing to the oil filter 40 is not significantly impacted.

For example, a peak pressure at a first location 60 upstream of the cooler bypass 20 is greater than an exit pressure at a second location 62 downstream of the cooler outlet 36 of the oil cooler 32. Based on the peak pressure at the first location 60 being greater than the exit pressure at the second location 62, the flow restrictor 58 is, thus, appropriately dimensioned and configured to provide the desired pressure and flow of oil through the monitoring system 50, which is less than the peak pressure at the first location 60 and is in compliance with the operational pressure and flow parameters of the monitoring device 56. As such, the monitoring device 56 receives the oil at the desired pressure and flow for monitoring the oil, which then flows to oil filter 40 via the output conduit 54. In some other embodiments, the flow restrictor 58 (illustrated as dotted lines in FIG. 2) is disposed in the input conduit 52 instead of the output conduit 54 to effect the same desired pressure and flow through the monitoring device 56 of the monitoring system 50.

Still referring to FIG. 2, the monitoring device 56 is configured to monitor oil quality parameters and/or monitor debris in the oil. In some embodiments, the monitoring device 56 includes an oil quality sensor 64 for monitoring oil quality parameters such as, but not limited to, oil temperature, viscosity, density, and dielectric constant. Additionally or alternatively, the monitoring device 56 includes an oil debris sensor 66 for measuring metallic (e.g. ferrous and/or non-ferrous) and/or non-metallic debris in the oil.

INDUSTRIAL APPLICABILITY

In general, the present disclosure may find applicability with engines utilized in high power applications for any number of industrial settings such as, but not limited to, marine propulsion, earth-moving, construction, and agricultural settings. As a non-limiting example, the engine 10 may be a marine engine. By utilizing the systems and methods disclosed herein, the monitoring system 50 may monitor parameters of the oil circulating through engines utilized in high power applications, such as the engine 10, such that the monitoring device 56 receives oil for monitoring, without direct exposure to the high pressure and flow of oil circulating through the engine 10 and the lubrication system 12, at a desired pressure and flow that is in compliance with the operational pressure and flow requirements of the monitoring device 56.

In particular, the flow restrictor 58 of the monitoring system 50 is designed and configured to limit the flow of oil received by the monitoring device 56 based on the peak pressure at the first location 60 upstream of the cooler bypass 20 and the exit pressure at the second location 62 downstream of the oil cooler 32 (e.g. the dimensions of the flow restrictor 58 are appropriately designed based on the peak pressure and the pressure drop across the oil cooler 32). As a result, monitoring devices, such as the monitoring device 56, having strict operational pressure and flow requirements are capable of being implemented in engines, such as the engine 10, utilized in high power applications.

Additionally, the teachings of this disclosure can be employed such that the monitoring device 56 receives oil for monitoring while the oil continuously circulates through the engine 10 and the lubrication system 12 without any loss of oil during monitoring. For example, as the engine 10 is operating, the majority of the oil flowing from the pump 14 is supplied to the cooler bypass 20 via the supply flow path 22 while a portion of the oil is diverted therefrom to flow through the input conduit 52 to the monitoring device 56 at the desired pressure and flow provided by the flow restrictor 58 of the monitoring system 50. After the oil circulates across the monitoring device 56 for monitoring the parameters of the oil, the oil subsequently flows through the output conduit 54 to the oil filter 40 for filtering the oil before continuing to flow to the engine 10. In such a manner, substantially all of the oil supplied from the pump 14 is circulated to the engine 10 for lubricating and cooling, as the monitored oil circulates to the engine 10, as well as the oil exiting the oil cooler 32, via the oil filter 40. This may be contrasted from other systems in which oil is diverted to the oil pan or sump after being monitored such that the engine receives less oil than initially supplied from the pump.

Figure 5:
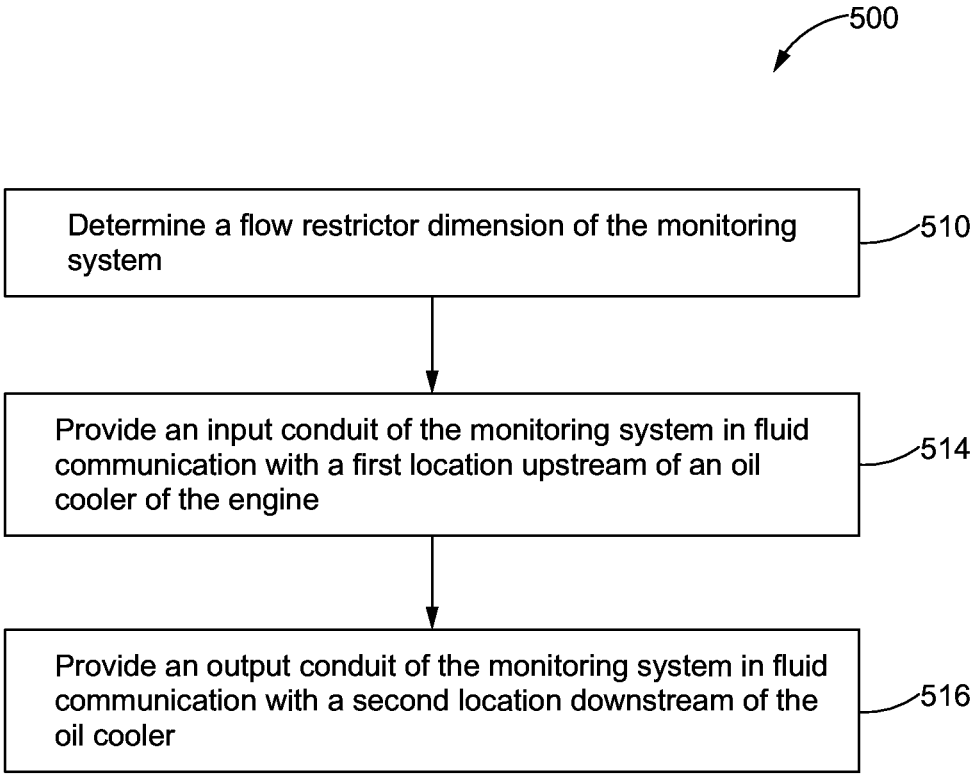
FIG. 5 is a block diagram illustrating a sample sequence of steps which may be practiced in accordance with the teachings of the present disclosure.

Moreover, in some embodiments, the monitoring system 50 is adapted for utilization on post-manufactured engines that include an oil cooler such as engines already in existence, which may have already been used in the field. FIG. 5 illustrates a block diagram 500 of a sample sequence of steps which may be performed to provide a monitoring system to a post-manufactured engine that includes an oil cooler. As illustrated at block 510, the dimension of the flow restrictor 58 of the monitoring system 50 is determined based on the peak pressure at the first location 60 upstream of the oil cooler 32 and the exit pressure at the second location 62 downstream of the oil cooler 32. In some embodiments, the first location 60 is upstream of the cooler bypass 20, which is disposed upstream of the oil cooler 32.

The input conduit 52 of the monitoring system 50 is provided in fluid communication with the first location 60, as illustrated in block 512. In some embodiments, the input conduit 52 includes a input fitting, which is adapted to fluidly couple to the first location 60. Further, the output conduit 54 of the monitoring system 50 is provided in fluid communication with the second location 62, as illustrated in block 514. In some embodiments, the output conduit 54 includes an output fitting, which is adapted to fluidly couple to the second location 62.

What is claimed is:

1. A monitoring system for monitoring fluid parameters in a lubrication system of an engine, the lubrication system including an oil cooler, and a cooler bypass having a bypass valve and being in fluid communication with a bypass conduit and a cooler flow conduit to the oil cooler, the monitoring system comprising:

an input conduit configured to be in fluid communication with the lubrication system at a first location upstream of the oil cooler and the cooler bypass having the bypass valve;

a monitoring device in fluid communication with the input conduit, the monitoring device being configured to measure a characteristic of a fluid flowing to the monitoring device via the input conduit; and an output conduit in fluid communication with the monitoring device, the output conduit configured to be in fluid communication with the lubrication system at a second location downstream of the oil cooler and the cooler bypass having the bypass valve, the output conduit including a flow restrictor configured to provide a predetermined pressure and flow of the fluid to the monitoring device via the input conduit, wherein the input conduit and the output conduit are distinct from the bypass conduit and the cooler flow conduit.

2. The monitoring system of claim 1, wherein the flow restrictor is configured to provide the predetermined pressure and flow of the fluid to the monitoring device based on a peak pressure at the first location and an exit pressure at the second location.

3. The monitoring system of claim 1, wherein the predetermined pressure and flow of the fluid is in compliance with an operational pressure and flow requirement of the monitoring device.

4. The monitoring system of claim 1, wherein the monitoring device includes an oil quality sensor configured to monitor one of oil temperature, viscosity, density, and dielectric constant as the characteristic of the fluid flowing to the monitoring device via the input conduit.

5. The monitoring system of claim 1, wherein oil is the fluid flowing to the monitoring device via the input conduit, and wherein the monitoring device includes an oil debris sensor configured to measure metallic and non-metallic debris in the oil as the characteristic of the fluid flowing to the monitoring device via the input conduit.

6. The monitoring system of claim 1, wherein the output conduit is further configured to be in fluid communication with the engine.

7. An engine, comprising:

a pump;

a cooler bypass in fluid communication with, and downstream of, the pump, the cooler bypass including a bypass valve and being in fluid communication with a bypass conduit and a cooler flow conduit;

an oil cooler in fluid communication with, and downstream of, the cooler bypass; and a monitoring system fluidly coupling a first location upstream of the cooler bypass to a second location downstream of the oil cooler, the monitoring system including a flow restrictor configured to provide a predetermined pressure and flow of a fluid to flow through the monitoring system from the first location to the second location, wherein the monitoring system is configured to measure a characteristic of the fluid flowing through the monitoring system, wherein the cooler bypass and the oil cooler are in a first flow path for the fluid, and wherein the monitoring system is in a second flow path for the fluid distinct from the first flow path.

8. The engine of claim 7, wherein the monitoring system further includes a monitoring device in fluid communication with the first location via an input conduit and in fluid communication with the second location via an output conduit.

9. The engine of claim 8, wherein the flow restrictor is disposed in the input conduit.

10. The engine of claim 8, wherein the flow restrictor is disposed in the output conduit.

11. The engine of claim 10, wherein the flow restrictor is configured to provide the predetermined pressure and flow of the fluid through the monitoring system based on a peak pressure at the first location and an exit pressure at the second location.

12. The engine of claim 11, wherein the predetermined pressure and flow of the fluid is in compliance with an operational pressure and flow requirement of the monitoring device.

13. The engine of claim 8, wherein the monitoring device includes an oil quality sensor configured to monitor one of oil temperature, viscosity, density, and dielectric constant.

14. The engine of claim 8, wherein the monitoring device includes an oil debris sensor configured to measure metallic and non-metallic debris in oil as the fluid.

15. The engine of claim 7, wherein the second location is in fluid communication with the engine via an oil filter.

16. A lubrication system for an engine, comprising:

an oil cooler including a cooler inlet and a cooler outlet, the cooler inlet upstream of the cooler outlet;

a cooler bypass having a bypass valve and being in fluid communication with a bypass conduit and a cooler flow conduit to the oil cooler;

a first location upstream of the cooler inlet and the cooler bypass;

a second location downstream of the cooler outlet; and a monitoring device including an input conduit and an output conduit, the input conduit in fluid communication with the first location, the output conduit in fluid communication with the second location, one of the input conduit and the output conduit including a flow restrictor configured to provide a predetermined pressure and flow of a fluid to the monitoring device via the input conduit, wherein the monitoring device is configured to measure a characteristic of the fluid flowing to the monitoring device via the input conduit, and wherein the input conduit and the output conduit are distinct from the bypass conduit and the cooler flow conduit.

17. The lubrication system of claim 16, wherein the flow restrictor is configured to provide the predetermined pressure and flow of the fluid to the monitoring device based on a peak pressure at the first location and an exit pressure at the second location.

18. The lubrication system of claim 16, wherein the predetermined pressure and flow of the fluid is in compliance with an operational pressure and flow requirement of the monitoring device.

19. The lubrication system of claim 16, wherein the monitoring device includes an oil quality sensor configured to monitor one of oil temperature, viscosity, density, and dielectric constant.

20. The lubrication system of claim 16, wherein the monitoring device includes an oil debris sensor configured to measure metallic and non-metallic debris in the oil.

* * * * *